US005890754A

United States Patent [19]

Murr

[11] Patent Number: 5,890,754

[45] Date of Patent: Apr. 6, 1999

[54] GRAPPLE CLAW ATTACHMENT FOR A BACKHOE

[76] Inventor: Wayne L. Murr, 11416 Snyder Rd., Knoxville, Tenn. 37932

[21] Appl. No.: 975,580

[22] Filed: Nov. 21, 1997

[51] Int. Cl.[6] ..... B66C 3/16

[52] U.S. Cl. ..... 294/107; 294/88; 414/739; 414/912

[58] Field of Search ..... 294/105–107, 294/88, 68.23, 115; 37/405, 406, 187; 414/729, 738, 739, 912, 920

[56] References Cited

U.S. PATENT DOCUMENTS

| | | | |
|---|---|---|---|
| 3,048,288 | 8/1962 | Dwyer | 414/739 |
| 3,310,335 | 3/1967 | Shuey | 294/106 |
| 3,772,806 | 11/1973 | Meadows | 37/187 |
| 4,818,005 | 4/1989 | Purser | 294/107 |
| 5,033,785 | 7/1991 | Wooley, Jr. . | |
| 5,062,227 | 11/1991 | DeGier et al. . | |
| 5,150,936 | 9/1992 | Avery . | |
| 5,172,951 | 12/1992 | Jacobsen et al. . | |
| 5,192,104 | 3/1993 | Lin . | |
| 5,209,536 | 5/1993 | Rogers, Sr. et al. . | |
| 5,244,338 | 9/1993 | White . | |
| 5,328,223 | 7/1994 | Maggio . | |
| 5,328,224 | 7/1994 | Jacobsen et al. . | |
| 5,486,085 | 1/1996 | Gagne et al. . | |
| 5,544,435 | 8/1996 | Somero et al. . | |
| 5,641,190 | 6/1997 | Christensen . | |

FOREIGN PATENT DOCUMENTS

| | | | |
|---|---|---|---|
| 1393-755 | 5/1988 | U.S.S.R. | 294/106 |

*Primary Examiner*—Dean Kramer
*Attorney, Agent, or Firm*—Pitts & Brittian, P.C.

[57] ABSTRACT

A grapple claw for attachment to a backhoe adapted to be interchangeable with a standard backhoe bucket. Grapple claw (10) includes a main frame member (50), a pivoting stop member (52) that engages the arm (30) and restricts the rotation of the frame (50) around the arm's distal end (35). Grapple claw (10) also includes at least a pair of opposing interlocking claws (54) and (56), respectively pivotally secured to the frame (50). In this regard, claw (54) pivots about fulcrum point (55) and claw (56) pivots about fulcrum point (57). A rotation imparting device (60) is pivotally connected between ram (45) and claws (54) and (56) for applying moments in opposite directions about fulcrum points (55) and (57) to effect the opening and closing of claws (54) and (56). Thus the opening and closing of claws (54) and (56) is accomplished by a single hydraulic ram is accomplished and the necessity for an auxiliary hydraulic circuit and associated ram is alleviated.

8 Claims, 3 Drawing Sheets

GRAPPLE CLAW ATTACHMENT FOR A BACKHOE

TECHNICAL FIELD

This invention relates to the field of claw attachments. More particularly, it relates to a hydraulically operated claw attachment for mounting on the articulated boom of a backhoe.

BACKGROUND ART

Backhoes are frequently utilized during the excavation of residential, small business and other types of work sites. As known in the art, backhoes typically are equipped with a hydraulically operated front end loader and a consisting typically of a bucket mounted on an arm that is mounted on an articulated boom. Four hydraulic actuators, or rams, provide for side-to-side pivoting of the boom, raising and lowering the boom, flexing and extending the arm in relation to the boom, and actuation of the bucket. As known in the art, it is frequently necessary to remove large tree trunks from the work site. This action requires the use of opposable claws, rather than the bucket typically found on the backhoe. Heretofore, an end effector mountable on the distal end of the arm required an additional hydraulic ram in order to provide actuation of the claws for the purpose of grasping the logs.

Typical of the art regarding end effectors and claw mechanisms are the following U.S. Patents: U.S. Pat. No. 5,544,435 issued to Somero on Aug. 13, 1996, discloses a brush rake for attachment to an arm equipped with a bucket. The Somero device is used in conjunction with the bucket and requires an additional hydraulic ram. U.S. Pat. No. 5,150,936 issued to Avery on Sep. 29, 1992, discloses a grapple assembly for attachment to a workhead. Avery's grapple is designed to be received by a shear that is actuated by two hydraulic rams. Finally, U.S. Pat. No. 5,328,223 issued to Maggio on Jul. 12, 1994, discloses an end grapple for use on loader tractors in nurseries to load and unload trees and shrubs onto and off of trucks. Maggio's pivotal fingers require the use of an hydraulic ram (64) in addition to the hydraulic ram (14) utilized to pivot the workhead with relation to the distal end of the arm. Other known patents include the following:

| Inventor | U.S. Pat. No. | Date Issued |
|---|---|---|
| Wooley, jr. | 5,033,785 | Jul. 23, 1991 |
| De Gier et al. | 5,062,227 | Nov. 5, 1991 |
| Jacobsen et al. | 5,172,951 | Dec. 22, 1992 |
| Lin | 5,192,104 | Mar. 9, 1993 |
| Rogers, Sr. et al. | 5,209,536 | May 11, 1993 |
| White | 5,244,338 | Sep. 14, 1993 |
| Jacobsen et al. | 5,328,224 | Jul. 12, 1994 |
| Gagne et al. | 5,486,085 | Jan. 23, 1996 |
| Christensen | 5,641,190 | Jun. 24, 1997 |

What is missing from the art is a claw grapple that can be readily interchanged with a typical bucket on a backhoe arm without requiring an additional hydraulic ram to actuate the claw mechanism.

Accordingly, it is an object of the present invention to provide a grapple having opposable claws that is adapted to be carried by the distal end of the arm on a backhoe.

A further object of the present invention is to provide a grapple claw in which the opposing claw members are actuated by the single hydraulic ram that actuates a typical backhoe bucket.

Still another object of the present invention is to provide a grapple claw that is readily interchangeable with the bucket of a state of the art backhoe.

Other objects and advantages over the prior art will become apparent to those skilled in the art upon reading the detailed description together with the drawings as described as follows.

DISCLOSURE OF THE INVENTION

In accordance with the various features of this invention, a grapple claw for attachment to a backhoe is provided. The grapple claw is adapted to be interchangeable with a standard backhoe bucket. A typical backhoe includes a boom mounted on the rear of a tractor. The boom is actuated by hydraulic rams that allow the boom to be swivelled from side to side and that raise and lower the boom. Attached to the distal end of the boom is an arm the flexion or extension of which, with relation to its angle with the boom, is controlled by a further hydraulic ram. Further, typically a bucket is carried by the distal end of the arm. In this regard, the bucket and its linkage are pivotally secured to the distal end of the arm such that the bucket can pivot around the distal end of the arm in a scooping motion. The bucket is actuated by a further hydraulic ram. The grapple claw is adapted to be interchangeable with the bucket and is secured to the distal end of the arm and includes a linkage member that is secured to the arm in the same manner as the bucket linkage. The grapple claw includes a main frame member, a pivoting stop member that engages the arm and restricts the rotation of the frame around the arm's distal end, a pair of opposing interlocking claws, and a rotation imparting device that is interconnected between the otherwise bucket actuating hydraulic ram and the opposing claw members so as to apply moments of opposite directions about the opposing claws' fulcrum points thereby effecting the opening and closing of the opposing claw members. In the preferred embodiment, the rotation imparting device is defined by a lever arm and linkage assembly that is configured such that extension of the hydraulic ram causes the opposing claws to pivot towards each other into the closed and interlocked position and further such that retraction of the hydraulic ram causes the claws to pivot away from each other into the open position. In this manner, the necessity for an auxiliary hydraulic circuit and associated ram is alleviated.

BEST MODE FOR CARRYING OUT THE INVENTION

Figure 1:
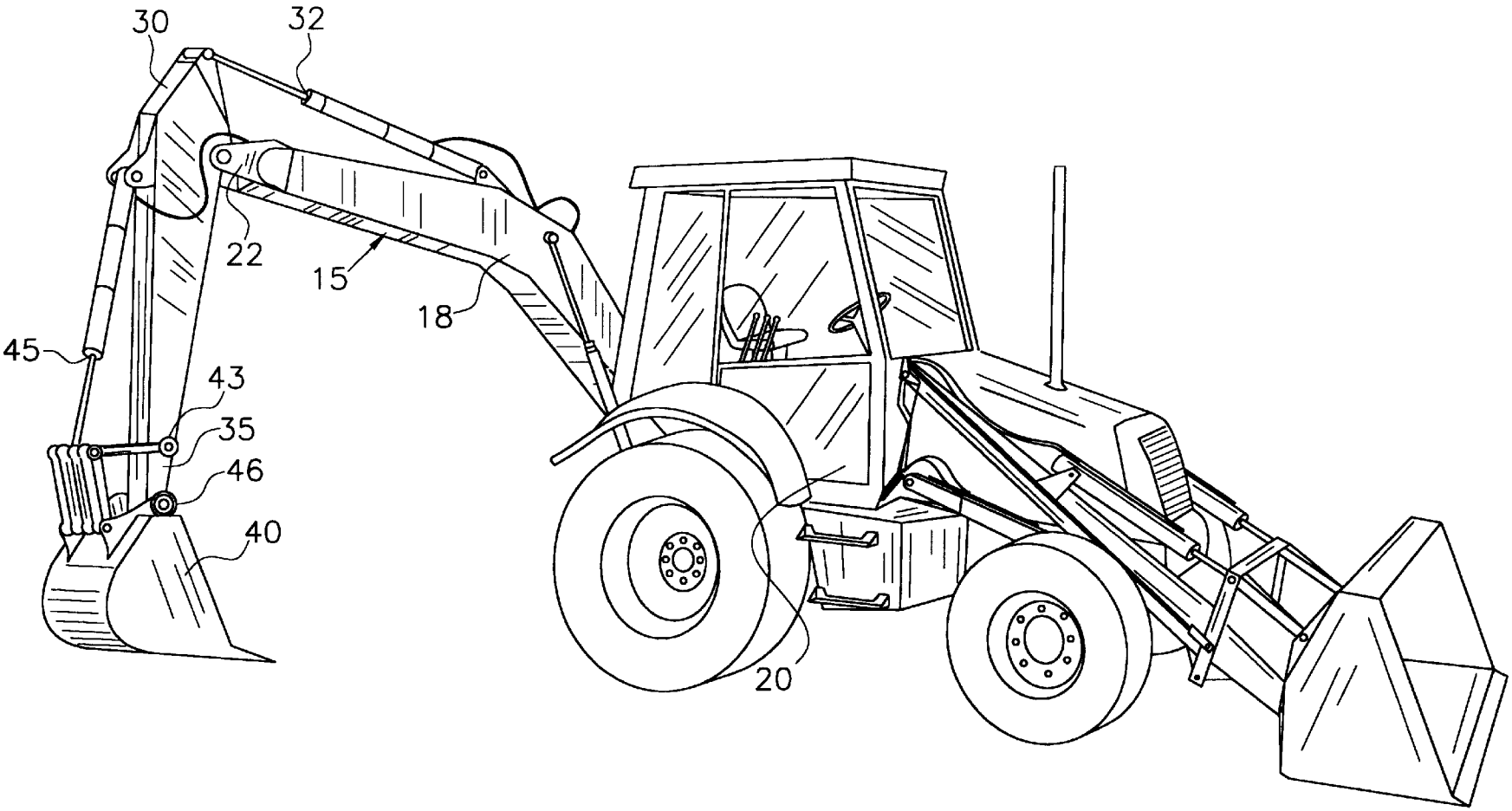
Fig. 1 (PRIOR ART)
FIG. 1 illustrates a perspective view of a state of the art tractor with a backhoe and a typical bucket mounted thereon.
Figure 2:
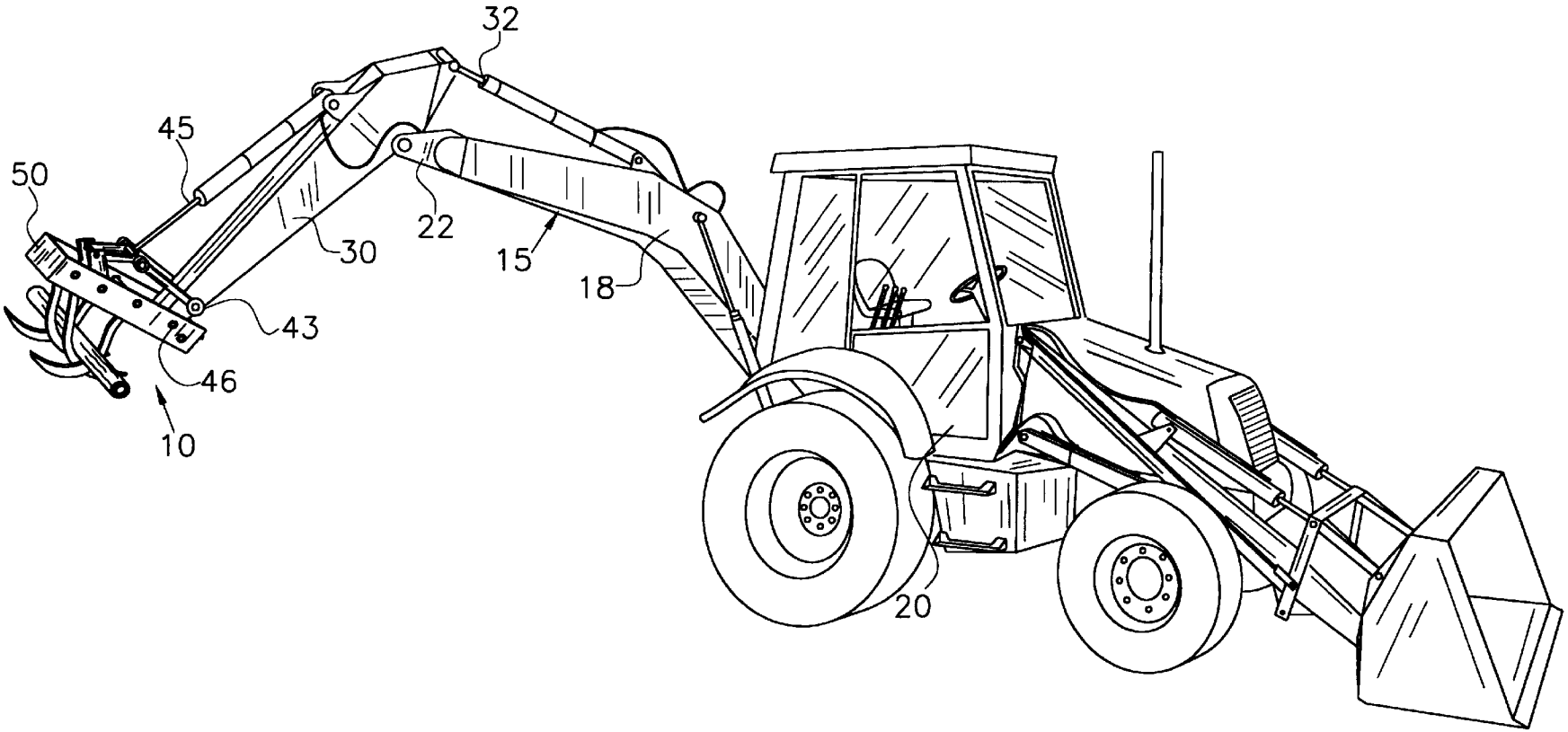
FIG. 2 illustrates a perspective view of a state of the art tractor with a backhoe boom and arm and the grapple claw of the present invention mounted on the distal end of the arm.
Figure 3:
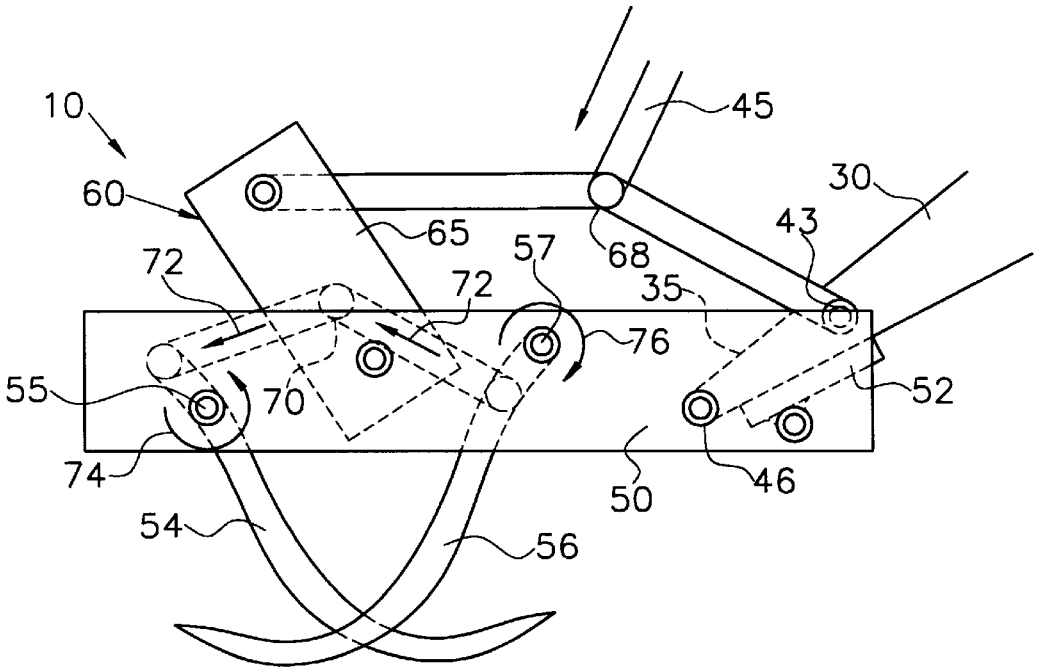
FIG. 3 illustrates a side view of the grapple claw of the present invention in the closed position showing the relational orientation of the linkage assembly with respect to the opposing claws.
Figure 4:
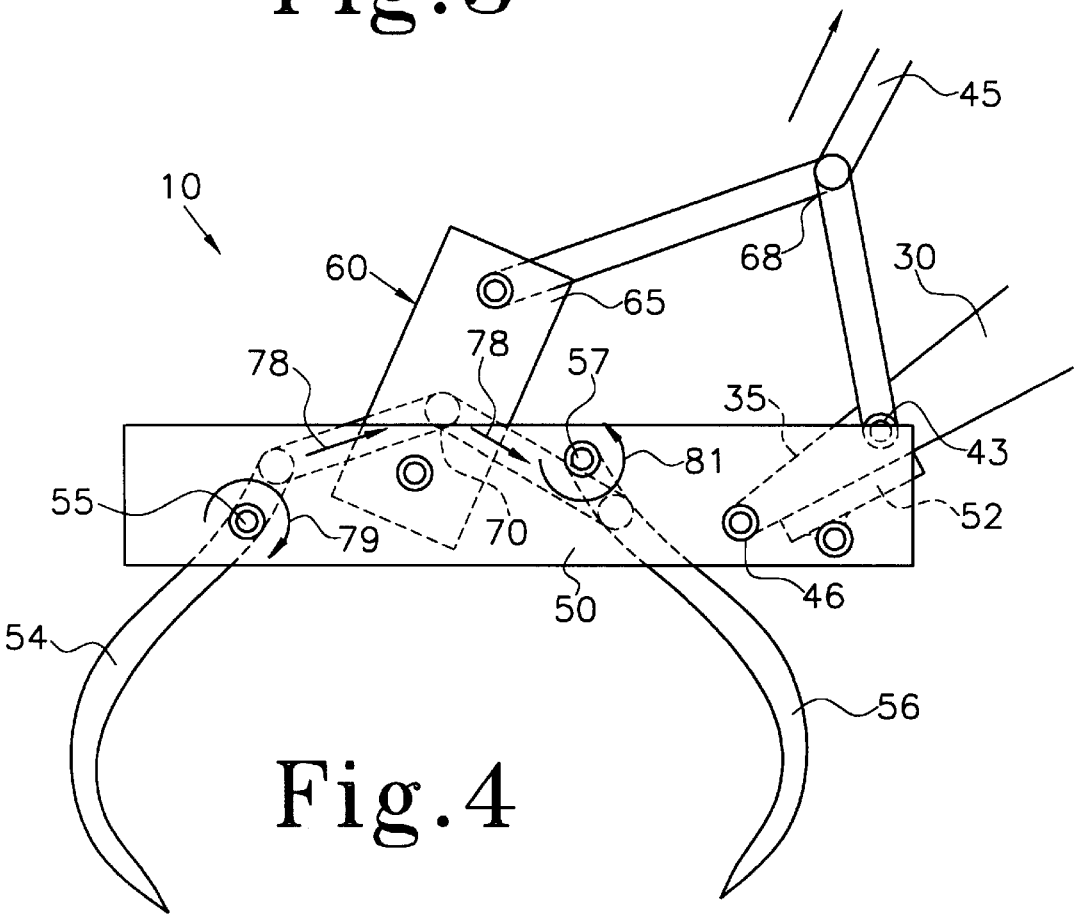
FIG. 4 illustrates a side view of the grapple claw of the present invention in the open position showing the relational orientation of the linkage assembly with respect to the opposing claws.

A grapple claw for attachment to a backhoe, constructed in accordance with the present invention, is illustrated generally as 10 in the figures. Grapple claw 10 is adapted to be interchangeable with a standard backhoe bucket. As understood by those skilled in the art, a typical backhoe 15 includes a boom 18 mounted on the rear of a tractor 20. As understood by those skilled in the art, the backhoe's various components are actuated by a plurality of fluid operated cylinders, such as, hydraulic rams. The boom 18 is actuated by hydraulic rams (not shown) that allow the boom 18 to be swivelled from side to side and that raise and lower the boom 18. Attached to the distal end 22 of the boom 18 is an arm 30, the flexion or extension of which, with relation to its angle with the boom 18, is controlled by a further hydraulic ram 32. Typically, the distal end 35 of arm 30 carries a bucket 40 which is pivotally linked to distal end 35 of arm 30 at first and second pivot points 43 and 46, respectively. First and second pivot point, 43 and 46, allow the bucket 40 to pivot around the distal end 35 of the arm 30 in a scooping motion. The bucket 40 is actuated by a further hydraulic ram 45. The grapple claw 10 is adapted to be interchangeable with the bucket 40. In this regard, grapple claw 10 includes a main frame member 50, a pivoting stop member 52 that engages the arm 30 and restricts the rotation of the frame 50 around the arm's distal end 35. Grapple claw 10 also includes at least a pair of opposing interlocking claws 54 and 56, respectively pivotally secured to the frame 50. In the preferred embodiment, grapple claw 10 includes a pair of forwardly placed claws 54 and an opposing pair of rearwardly placed claws 56. The functioning of these pairs of claws will be discussed with respect to a single side, it being understood that the other side is a mirror image and operates in tandem with the described side. In this regard, claw 54 pivots about fulcrum point 55 and claw 56 pivots about fulcrum point 57. A rotation imparting device 60 is pivotally connected between ram 45 and claws 54 and 56 for applying moments in opposite directions about fulcrum points 55 and 57 to effect the opening and closing of claws 54 and 56. In the preferred embodiment, rotation imparting device 60 is defined by a lever arm 65 and a linkage assembly made up of a first pivoting linkage 68 interconnected between ram 45 and arm 30, (which is secured to arm 30 at pivot point 43), and a second pivoting linkage interconnected between claws 54 and 56 and lever arm 65. Lever arm 65 and pivoting linkages 68 and 70 are preferably configured such that extension of hydraulic ram 50 pushes linkage 70 in the direction of arrows 72 which acts to apply moments of opposing directions, shown by arrows 74 and 76 respectively, about fulcrum points 55 and 57 thereby causing opposing claws 54 and 56 to pivot towards each other into the closed and interlocked position shown in FIG. 3. Further, retraction of hydraulic ram 50 pushes linkage 70 in the direction of arrows 78 which acts to apply moments of opposing directions, shown by arrows 79 and 81 respectively, about fulcrum points 55 and 57 thereby causing opposing claws 54 and 56 to pivot away from each other into the open position shown in FIG. 4. Thus the opening and closing of claws 54 and 56 is accomplished by a single hydraulic ram is accomplished and the necessity for an auxiliary hydraulic circuit and associated ram is alleviated.

From the foregoing description, it will be recognized by those skilled in the art that a grapple claw for attachment to a backhoe offering advantages over the prior art has been provided. Specifically, the grapple claw provides a grapple having opposable claws that is adapted to be carried by the distal end of the arm on a backhoe. Further the grapple claw provides a grapple claw in which the opposing claw members are actuated by a single hydraulic ram and that is readily interchangeable with the bucket of a state of the art backhoe.

While a preferred embodiment has been shown and described, it will be understood that it is not intended to limit the disclosure, but rather it is intended to cover all modifications and alternate methods, such as other fluid operated cylinders or other rotation imparting devices falling within the spirit and the scope of the invention as defined in the appended claims.

Having thus described the aforementioned invention, I claim:

1. A grapple claw for mounting on a backhoe equipped with a boom, an arm and a fluid operated ram for controlling movements of the grapple claw, said grapple claw comprising:

a frame member removably secured to a distal end of the arm, a pivoting stop member carried by said frame member for engaging the arm and for restricting pivotal rotation of said frame member around the distal end of the arm;

at least one pair of opposing interlocking claw members pivotally secured to said frame member, wherein said pair of opposing interlocking claw members is defined by a first claw member that pivots about a first fulcrum point and a second claw member that pivots about a second fulcrum point; and a rotation imparting device pivotally connected between the ram and said first and second claws for applying moments in opposite directions about said first and second fulcrum points to effect opening and closing of said pair of opposing claw members.

2. The grapple claw of claim 1 wherein said grapple claw comprises a pair of forwardly placed grapple claws and an opposing pair of rearwardly placed grapple claws.

3. The grapple claw of claim 1 wherein said rotation imparting device is defined by a lever arm pivotally secured to said frame, a first linkage assembly pivotally connected to the fluid operated ram and for pivotally interconnecting said lever arm and the arm of the boom and a second linkage assembly pivotally connected to said lever arm and said pair of opposing claw members, said first and second linkage assemblies being configured such that actuation of said lever arm by the fluid operated ram applies moments in opposite directions about said first and said second fulcrum points to effect opening and closing of said pair of opposing claw members.

4. A grapple claw for mounting on a backhoe equipped with a boom, an arm and a fluid operated ram for controlling movements of the grapple claw, said grapple claw comprising:

a frame member removably secured to a distal end of the arm, a pivoting stop member carried by said frame member for engaging the arm and for restricting pivotal rotation of said frame member around the distal end of the arm;

at least one pair of opposing interlocking claw members pivotally secured to said frame member, wherein said pair of opposing interlocking claw members is defined by a first claw member that pivots about a first fulcrum point and a second claw member that pivots about a second fulcrum point; and a lever arm pivotally secured to said frame, a first linkage assembly pivotally connected to the fluid operated ram and for pivotally interconnecting said lever arm and the arm of the boom and a second linkage assembly pivotally connected to said lever arm and said pair of opposing claw members, said first and second linkage assemblies being configured such that actuation of said lever arm by the fluid operated ram applies moments in opposite directions about said first and said second fulcrum points to effect opening and closing of said pair of opposing claw members.

5. The grapple claw of claim 4 wherein said grapple claw comprises a pair of forwardly placed grapple claws and an opposing pair of rearwardly placed grapple claws.

6. A grapple claw for mounting on a backhoe equipped with a boom, an arm and a fluid operated ram for controlling movements of the grapple claw, said grapple claw comprising:

a frame member removably secured to a distal end of the arm, a pivoting stop member carried by said frame member for engaging the arm and for restricting pivotal rotation of said frame member around the distal end of the arm;

at least one pair of opposing interlocking claw members pivotally secured to said frame member, wherein said pair of opposing interlocking claw members is defined by a first claw member that pivots about a first fulcrum point and a second claw member that pivots about a second fulcrum point; and means pivotally connected between the ram and said first and second claws for applying moments in opposite directions about said first and second fulcrum points to effect opening and closing of said pair of opposing claw members.

7. The grapple claw of claim 6 wherein said grapple claw comprises a pair of forwardly placed grapple claws and an opposing pair of rearwardly placed grapple claws.

8. The grapple claw of claim 6 wherein said means pivotally connected between the ram and said first and second claws for applying moments in opposite directions about said first and second fulcrum points to effect opening and closing of said pair of opposing claw members includes a lever arm pivotally secured to said frame, a first linkage assembly pivotally connected to the fluid operated ram and for pivotally interconnecting said lever arm and the arm of the boom and a second linkage assembly pivotally connected to said lever arm and said pair of opposing claw members, said first and second linkage assemblies being configured such that actuation of said lever arm by the fluid operated ram applies moments in opposite directions about said first and said second fulcrum points to effect opening and closing of said pair of opposing claw members.

* * * * *